US006918427B2

(12) United States Patent
Yurko et al.

(10) Patent No.: US 6,918,427 B2
(45) Date of Patent: Jul. 19, 2005

(54) PROCESS AND APPARATUS FOR PREPARING A METAL ALLOY

(75) Inventors: James A. Yurko, Holland, MI (US); Rodger W. Brower, Allendale, MI (US); Raul A. Martinez, Somerville, MA (US); Merton C. Flemings, Cambridge, MA (US); Paolo Bertelli, Brescia (IT)

(73) Assignee: IdraPrince, Inc., Holland, MI (US)

( * ) Notice: Subject to any disclaimer, the term of this patent is extended or adjusted under 35 U.S.C. 154(b) by 0 days.

(21) Appl. No.: 10/761,911

(22) Filed: Jan. 21, 2004

(65) Prior Publication Data

US 2004/0173337 A1 Sep. 9, 2004

Related U.S. Application Data

(60) Provisional application No. 60/476,438, filed on Jun. 6, 2003, and provisional application No. 60/451,748, filed on Mar. 4, 2003.

(51) Int. Cl.[7] ..... B22D 27/08

(52) U.S. Cl. ..... 164/71.1; 164/113; 164/122; 164/900; 164/312; 266/241; 266/242

(58) Field of Search ..... 164/71.1, 113, 164/122, 900, 312; 266/241, 242

(56) References Cited

U.S. PATENT DOCUMENTS

| | | | |
|---|---|---|---|
| 3,902,544 | A | 9/1975 | Flemings et al. |
| 3,948,650 | A | 4/1976 | Flemings et al. |
| 4,108,643 | A | 8/1978 | Flemings et al. |
| 4,565,241 | A | 1/1986 | Young |
| 4,771,818 | A | 9/1988 | Kenney |
| 4,832,112 | A | 5/1989 | Brinegar et al. |
| 5,413,644 | A | 5/1995 | Marder et al. |
| 5,533,562 | A | 7/1996 | Moschini et al. |
| 5,555,926 | A | 9/1996 | Uchimura et al. |
| 5,571,346 | A | 11/1996 | Bergsma |
| 5,679,182 | A | 10/1997 | Marder et al. |
| 5,697,425 | A | 12/1997 | Nanba et al. |
| 5,701,942 | A | 12/1997 | Adachi et al. |
| 5,711,366 | A | 1/1998 | Mihelich et al. |
| 5,730,198 | A | 3/1998 | Sircar |
| 5,819,839 | A | 10/1998 | Mihelich et al. |
| 5,865,240 | A | 2/1999 | Asuke |
| 5,881,796 | A | 3/1999 | Brown et al. |

(Continued)

FOREIGN PATENT DOCUMENTS

| | | |
|---|---|---|
| EP | 0745694 | 12/1996 |
| WO | WO98/03686 | 1/1998 |

OTHER PUBLICATIONS

Flemings, Merton C., "Behavior of Metal Alloys in the Semisolid State," *Metallurgical Transactions B*, vol. 22B, Jun. 1991, pp. 269–293.

*Primary Examiner*—Tom Dunn
*Assistant Examiner*—I.-H. Lin
(74) *Attorney, Agent, or Firm*—Price, Heneveld, Cooper, DeWitt & Litton

(57) ABSTRACT

A method and apparatus for producing a metal component from a non-dendritic, semi-solid metal alloy slurry involves the use of a graphite agitator that is functionally equivalent to conventional metal rod agitators, and has the additional advantage of having a very low surface wettability, whereby labor and expenses associated with removing a metal alloy skin formed after withdrawal of the agitator from a metal slurry is eliminated or at least substantially reduced. The invention also provides an improved process and apparatus for producing a metal component from a non-dendritic semi-solid metal slurry by transferring the slurry to a cooling vessel for subsequent cooling and raising of the solids content without agitation after the slurry has been formed with agitation in a first vessel, whereby more rapid cooling of the slurry and increased production rates are achievable.

27 Claims, 1 Drawing Sheet

U.S. PATENT DOCUMENTS 5,887,640 A 3/1999 Brown et al.
5,901,778 A 5/1999 Ichikawa et al.
5,911,843 A 6/1999 Bergsma
5,954,116 A 9/1999 Jung
5,968,292 A 10/1999 Bergsma
5,980,660 A 11/1999 Garat et al.
5,983,978 A 11/1999 Vining et al.
5,996,679 A 12/1999 Pinnow et al.
6,059,012 A 5/2000 Vining et al.
6,065,526 A 5/2000 Kono
6,165,411 A 12/2000 Adachi et al.
6,241,001 B1 6/2001 Kono
6,250,364 B1 6/2001 Chung et al.
6,269,537 B1 8/2001 Kimura et al.
6,283,197 B1 9/2001 Kono
6,299,665 B1 10/2001 LeBeau et al.
6,308,768 B1 10/2001 Rice et al.
6,321,824 B1 11/2001 Fink et al.
6,399,017 B1 6/2002 Norville et al.
6,402,367 B1 6/2002 Lu et al.
6,432,160 B1 8/2002 Norville et al.
6,470,955 B1 * 10/2002 Richard et al. ..... 164/113
6,494,703 B2 12/2002 Kestle et al.
6,514,308 B2 2/2003 LeBeau et al.
6,514,309 B2 2/2003 LeBeau et al.
6,520,762 B2 2/2003 Kestle et al.
6,607,578 B2 * 8/2003 Otaki et al. ..... 75/414
6,633,492 B2 10/2003 Kimura et al.
6,640,879 B2 11/2003 Richard et al.
6,645,323 B2 11/2003 Flemings et al.
6,769,473 B1 * 8/2004 Adachi et al. ..... 164/71.1

* cited by examiner

PROCESS AND APPARATUS FOR PREPARING A METAL ALLOY

CROSS-REFERENCE TO RELATED APPLICATIONS

This application claims priority under 35 U.S.C. §119(e) on U.S. Provisional Application No. 60/451,748 entitled PROCESS AND APPARATUS FOR PREPARING A METAL ALLOY, filed Mar. 4, 2003, by James A Yurko et al., the entire disclosure of which is incorporated herein by reference and claims priority under 35 U.S.C. §119(e) on U.S. Provisional Application No. 60/476,438 entitled PROCESS AND APPARATUS FOR PREPARING A METAL ALLOY, filed Jun. 6, 2003, by James A Yurko et al., the entire disclosure of which is incorporated herein by reference.

FIELD OF THE INVENTION

This invention relates to industrial metal forming, and more particularly to an apparatus and process for forming metal components from non-dendritic, semi-solid metal slurries.

BACKGROUND OF THE INVENTION

It is well recognized that most metal alloy compositions solidify dendritically. That is dendritic or tree-like particles grow from nuclei as the alloy composition is cooled below the liquidus temperature. It is also well known that certain advantages are provided by fragmenting dendritic particles or preventing dendritic growth during solidification to form non-dendritic or degenerate dendritic particles having a generally spheroidal or ellipsoidal shape. More specifically, it has been discovered that various processing and physical property advantages can be achieved by casting or otherwise forming metal components from a non-dendritic, semi-solid metal slurry. The non-dendritic metal particles in the semi-solid slurry provide substantially reduced viscosity for a given solids fraction as compared with a semi-solid metal alloy composition containing dendritic particles. Often the difference in viscosity is several orders of magnitude.

The resulting benefits of non-dendritic semi-solid metal forming include higher speed part forming, high speed continuous casting, lower mold erosion, lower energy consumption, improved mold filling, reduced oxides that provide improved machinability in the finished metal components, and less gas entrapment resulting in reduced porosity. Other advantages of casting or otherwise forming metal components from a semi-solid slurry include less shrinkage during forming of the metal components, fewer voids and lower porosity in the formed metal components, less macrosegregation, and more uniform mechanical (e.g., strength) properties. It is also possible to form more intricate parts using non-dendritic, semi-solid alloy compositions during casting or other forming techniques. For example, parts having thinner walls with improved strength properties are possible.

Non-dendritic, semi-solid slurries for industrial casting and other metal forming processes have been prepared using mechanical mixing during cooling of a liquid metal alloy composition below the liquidus temperature of the alloy composition. Other techniques that have been utilized include electromagnetic stirring during cooling (typically for continuous casting processes), cooling a liquid metal composition while passing it through a torturous channel, long thermal treatments in the semi-solid temperature region, and others. These techniques are well known and have been advantageously employed in various commercially important applications.

More recently non-dendritic, semi-solid slurries have been created by relying upon the pouring of low superheated molten alloy into relatively cool containers (e.g. a crucible or the cold chamber of a die casting machine). These processes rely upon the cooling of the alloy composition from above the liquidus temperature to below the liquidus temperature during the pouring action as the alloy contacts the vessel walls. The process is effective in creating non-dendritic semi-solid slurries; however, there are process limitations. First, the process relies upon heat extraction from the vessel walls. It is difficult to control heat removal using this technique because of the changing temperature of the walls and the discrete surface area of the cylinder. Second, convection is created by the pour; therefore, if the alloy is introduced at too high of a temperature, convection forces dissipate before the alloy cools through the liquidus, preventing the formation of non-dendritic slurries.

Commercial products have included various aluminum and magnesium alloy components for automotive applications, such as master brake cylinders, and various components for steering and suspension systems. Other actual or potential applications include rocker arms, engine pistons, wheels, transmission components, fuel system components, and air conditioner components.

A problem with known techniques of forming a non-dendritic semi-solid metal slurry using mechanical agitation is that the surfaces of the agitator are wetted by the liquid metal in the slurry. As a result, some of the liquid metal from the slurry sticks to the surfaces of the agitator when it is removed from the slurry. Any liquid metal that wets or sticks to the surfaces of the agitator and/or the vessel quickly solidifies and forms a metal coating that must be removed before the agitator and/or vessel may be reused for preparation of more non-dendritc, semi-solid metal slurry. Removal of metal deposits from the surfaces of the agitator is typically difficult, time consuming, expensive, and leads to lower production rates. Materials having a reduced wettability are typically unsuitable for use in handling liquid metal alloy compositions (e.g., because they lack adequate mechanical properties at the high temperatures associated with the production of non-dendritic, semi-solid metal slurries) and/or do not have a sufficiently high thermal conductivity suitable for rapidly withdrawing heat from the non-dendritic, semi-solid metal slurries. Reduced wettability has been achieved by applying low wettability coatings to the surfaces of metal agitators. Boron nitride coatings have been used on agitator and/or vessel surfaces to successfully reduce wettability without adversely reducing thermal conductivity. However, the boron-nitride coatings lack structural strength, and require periodic replacement.

Another problem with conventional processes for preparing non-dendritic, semi-solid metal alloy compositions having a relatively high solids content (e.g., greater than about 10%) is that a considerable amount of time is typically required to cool the slurry to the desired solids content. Typically, agitation of the alloy composition occurs in a ceramic vessel or a preheated vessel in order to prevent nucleation and solid formation at the walls of the container or vessel in which the agitation is performed. As a result, cooling occurs relatively slowly, resulting in lengthy process times and reduced production. Rapid cooling can be achieved using a cool vessel having adequate mass, thermal conductivity and heat capacity. However, this can lead to unacceptably high temperature gradients that are not conducive to formation of non-dendritic semi-solid slurries, and/or cooling of the alloy composition to a temperature that is unsuitable for forming the alloy composition into a desired component.

U.S. Pat. No. 6,645,323 discloses a skinless metal alloy composition that is free of entrapped gas and comprises primary solid discrete degenerate dendrites homogenously dispersed within a secondary phase. The disclosed alloy is formed by a process in which metal alloy is heated in a vessel to render it a liquid. Thereafter, the liquid is rapidly cooled while being vigorously agitated under conditions that avoid entrapment of gas while forming solid nuclei homogenously distributed in the liquid. Cooling and agitation are achieved utilizing a cool rotating probe that extends into the liquid. Agitation is ceased when the liquid contains a small fraction solid or the liquid-solid alloy is removed from the source of agitation while cooling is continued to form the primary solid discrete degenerate dendrite in a liquid secondary phase. The solid-liquid mixture is then formed such as by casting. A problem with the process disclosed in U.S. Pat. No. 6,645,323 is that the cool rotating probes utilized for cooling and agitation tend to become coated with liquid metal that sticks to the surfaces of the agitator. As a result, the agitator as described in this patent requires frequent cleaning and/or replacement. Further, there remains a need for improving control over the amount of heat that is extracted from the aluminum alloy composition. In certain aspects of this invention, processes and apparatuses are provided for overcoming these deficiencies.

SUMMARY OF THE INVENTION

The invention provides an improved process for producing a non-dendritic, semi-solid alloy slurry for use in forming metal components. More specifically, the invention provides an apparatus and process that facilitates more rapid cooling of a non-dendritic, semi-solid metal slurry and/or eliminates or reduces problems associated with accumulation and removal of metal from surfaces of the apparatus contacting the slurry.

In accordance with an aspect of the invention, a process and apparatus are provided for preparing a non-dendritic, semi-solid metal alloy slurry utilizing a graphite agitator. The graphite agitator has suitable high temperature strength properties and a thermal conductivity that facilitates rapid cooling of a liquid alloy composition, while also exhibiting a relatively low wettability, whereby the need for removal of metal from the surface of the agitator after the agitator is withdrawn from the slurry is eliminated or substantially reduced, and any metal that does accumulate on the agitator can be easily removed. Thus, a graphite agitator may be employed to simultaneously withdraw heat from the alloy composition while also inducing convection that facilitates formation of a non-dendritic semi-solid alloy composition, and also while avoiding freezing or deposition of metal from the slurry onto the agitator.

In accordance with another aspect of the invention, the amount of heat extracted from the aluminum alloy composition is controlled by contacting the aluminum alloy composition with an agitator for a predetermined duration based on the initial temperature of the aluminum alloy composition before contact with the agitator and the heat extraction rate of the agitator.

In another aspect, there is provided a process and apparatus for more rapidly cooling a non-dendritic, semi-solid metal alloy slurry from a temperature at which the slurry has a relatively low solids content (e.g., about 1% to about 10% by weight) to a temperature at which the slurry has a relatively high solids content (e.g., from about 10% to about 65% by weight). The process and apparatus involve use of a container having walls of a material having a high thermal conductivity that facilitates rapid cooling of the slurry. Fans or blowers may be used for directing cool air around the container walls.

These and other features, advantages and objects of the present invention will be further understood and appreciated by those skilled in the art by reference to the following specification, claims and appended drawings.

DESCRIPTION OF THE PREFERRED EMBODIMENTS

Figure 1:
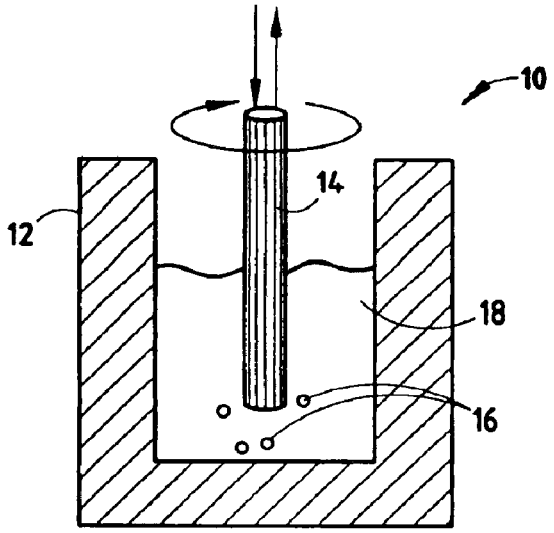
FIG. 1 is a schematic illustration of an apparatus in accordance with an embodiment of the invention.

Shown in FIG. 1 is an apparatus 10 for preparing a non-dendritic, semi-solid metal alloy composition in accordance with an embodiment of this invention.

A non-dendritic, semi-solid metal alloy composition is a composition containing liquid metal and discrete solid non-dendritic alloy particles dispersed in the liquid metal. Non-dendritic particles are particles that generally have a spheroidal or ellipsoidal shape, and which are formed as a result of convection in the liquid phase during nucleation and cooling of the liquid below the liquidus temperature of the alloy composition. One accepted theory is that the non-dendritic particles form as a result of convention which causes growing dendritic arms to break off, with subsequent ripening helping to smooth out the particles into the characteristic spheroidal and/or ellipsoidal shapes. For this reason, the non-dendritic particles are sometimes referred to as degenerate dendritic particles.

The apparatus includes a first holding vessel 12 for receiving and holding a liquid alloy composition while an agitator 14 is inserted into the liquid alloy composition and rotated to induce convection in the liquid alloy composition. The agitator also conducts heat from the alloy composition and induces nucleation. As a result of cooling the liquid alloy composition from a temperature just above the liquidus temperature to a temperature below the liquidus temperature, while agitating the composition, non-dendritic solid particles 16 develop from the liquid to form a semi-solid slurry 18. Desirably, the agitator is made of a material and has a mass that achieves rapid removal of heat from the alloy composition as the temperature of the alloy composition is lowered from a temperature slightly above the liquidus temperature to a temperature a few degrees below the liquidus temperature. That is, agitator 14 is desirably designed to rapidly withdraw the quantity of heat needed to establish a non-dendritic, semi-solid metal alloy composition typically having a solids content of from about 1% to about 20% by weight. The duration of stirring by the agitator controls the amount of heat extracted from the aluminum alloy composition. Therefore, if there are variations in initial metal temperature, the duration of stirring is controlled to result in a product with consistent temperature. The metal temperature may be determined using any of various devices such as an optical pyrometer, a thermocouple, etc.

Agitator 14 may for example have a cylindrical shape. Thus, agitator 14 may differ significantly from conventional agitators that physically break up the dendrites as they form. Instead, a cylindrical agitator that achieves rapid cooling creates nuclei or degenerate dendrites that are distributed with the convection created from the stirring motion. Thus, it is not necessary that the non-dendritic slurries be formed using traditional mechanical agitation that physically fragments dendritic arms.

In accordance with a preferred embodiment of the invention, the agitator is made of a material having a relatively high thermal conductivity, preferably comparable to the thermal conductivity of copper, and a relatively low wettability in the presence of aluminum, preferably comparable to boron nitride. An acceptable agitator could be a boron nitride coated copper agitator. However, it would be more desirable to provide an uncoated agitator having the desired thermal diffusivity to achieve rapid heat removal, which is important for preventing the agitator surfaces from approaching the liquidus temperature of the alloy composition, and the desired low wettability to prevent metal from accumulating or collecting on the surfaces of the agitator when it is withdrawn from the metal slurry. It has been discovered that a particularly useful material for fabricating agitator 14 is graphite. Graphite has a relatively high thermal diffusivity, e.g., comparable to copper, and a relatively low wettability, e.g., comparable to a boron nitride coating. It has been discovered that a graphite agitator has strength and thermal properties that are functionally equivalent to agitators commonly used for forming non-dendritic, semi-solid metal alloy slurries, and the added advantage of being essentially non-wetting to liquid metal alloys. As a result, it may be possible to repeatedly use the graphite agitator on several separate cycles without having to remove metal alloy from the surface of the agitator. However, the rod surface must be at a temperature below the liquidus temperature of the alloy to rapidly remove heat from the molten alloy. Further, any accumulated metal may be easily removed such as by passing the surfaces of the graphite agitator against a bushing.

The process of this invention comprises a first step of forming a metal alloy liquid composition. The liquid metal alloy composition is positioned within vessel 12 and cooled while vigorously agitating the cooled alloy such as by stirring under conditions to form solid nuclei particles while avoiding entrapment of gas within the agitated alloy composition. The alloy is vigorously agitated while being cooled in a manner such that the solid nuclei are distributed throughout the metal liquid alloy composition substantially homogeneously. Agitation may be effected while utilizing a rapid cooling rate range for short time such as between about 1 second and about 1 minute, preferably between about 1 and about 30 seconds over a temperature range corresponding to a percent solidification of the alloy of between about 1 and about 20% weight fraction solids, preferably between about 3 and about 7% weight fraction solids. Agitation can be effected utilizing a cool agitator in any manner which avoids excessive cavitation at the liquid surface to thereby avoid entrapment of gas in the liquid. The agitator can be rendered cool by passing a heat exchange fluid, such as water therethrough. Representative suitable agitation means include one or a plurality of cylindrical rods provided with an internal cooling means, a helical agitator, or the like, that preferably extends the depth of the liquid. The agitator extends into a portion of the depth of the liquid up to substantially 100% of the depth of the liquid to promote homogeneous dispersion of the crystal nuclei. Agitation then is ceased in a batch process or the liquid-solid alloy is removed form the source of agitation in a continuous process. The resultant liquid-solid metal alloy composition may then be cooled within the vessel to effect formation of spheroidal solid particles about the solid nuclei particles up to a concentration wherein the non-dendritic spheroidal and/or ellipsoidal solid particles increase the viscosity of the overall liquid-solid composition where it can be moved into a formation step such as a casting step. Generally, the upper weight percent of non-dendritic primary solids, is between about 40 and about 65 percent and preferably contains 10 to 50 percent based on the total weight of the liquid solid composition. The formation of spheroidal and/or ellipsoidal solid particles without agitation is effected by coarsening without the formation an interconnected dendrite network. Since agitation is effected only for a short period of time, the inclusion of entrapped gas within the alloy composition is avoided. In addition, it has been found that by operating in this manner, macrosegregation of elements is minimized or eliminated throughout the volume of the metal alloy product produced. The resultant liquid-solid composition is then formed such as by casting.

The metal alloy composition comprising the non-dendritic solid metal alloy particles and the liquid phase can be formed from a wide variety of metals or alloys which, when frozen from a liquid state without agitation form a dendritic network structure. The non-dendritic particles are made up of a single primary phase having an average composition different from the average composition of a surrounding secondary phase (liquid or solid depending on temperature), which secondary phase can itself comprise primary and secondary phases upon further solidification.

The non-dendritic solids (degenerate dendrites) are characterized by having smoother surfaces and less branched structures which approach a more spherical configuration than normal dendrities and do not have a dendrite structure where interconnection of the primary particles is effected to form a dendritic network structure. In addition, the primary solids are substantially free of eutectics. By the term "secondary solid" as used herein is meant the phase or phases that solidify from the liquid existing in the slurry at a lower temperature than at which the non-dendritic solid particles are formed. Normally solidified alloys have branched dendrites separated from each other in the early stages of solidification, i.e., up to 15 to 20 wt. percent solid, and develop into an interconnected network as the temperature is reduced and the weight fraction of solids increases. The composition containing primary, non-dendritic solids of this invention, on the other hand, prevents formation of the interconnected network by maintaining the discrete non-dendritic particles separated form each other by the liquid phase even up to solid fractions of about 65 weight percent.

The secondary solid which is formed during solidification form the liquid phase subsequent to forming the non-dendritic solid contains one or more phases of the type which would be obtained during solidification by conventional forming processes. That is, the secondary phase comprises solid solutions, or mixtures of dendrites, compounds and/or solid solutions.

The size of the non-dendritic particles depends upon the alloy or metal composition employed, the temperature of the solid-liquid mixture, and the time the alloy spends in the solid-liquid temperature range. In general, the size of the primary particles depends on composition, thermo-mechanical history of the slurry, number of crystal nuclei formed, cooling rate, and can range from about 1 to about 10,000 microns and are homogeneously sized throughout the metal alloy composition. It is preferred that the composition contain between 10 and 50 weight percent primary solids since these compositions have a viscosity which promotes ease of casting or forming.

The composition of this invention can be formed from any metal alloy system which, when frozen from the liquid state, forms a dendritic structure. Even though pure metals and eutectics melt at a single temperature, they can be employed to form the composition of this invention since they can exist in liquid-solid equilibrium at the melting point by controlling the net heat input or output to the melt so that, at the melting point, the pure metal or eutectic contain sufficient heat to fuse only a portion of the metal or eutectic liquid. This occurs since complete removal of heat of fusion in a slurry employed in the casting process of this invention cannot be obtained by equating the thermal energy supplied and that removed by a cooler surrounding environment. Representative suitable alloys include but are not limited to lead alloys, magnesium alloys, zinc alloys, aluminum alloys, copper alloys, iron alloys, cobalt alloys. Examples of these alloys are lead-tin alloys, zinc-aluminum alloys, zinc-copper alloys, magnesium-aluminum alloys, magnesium-aluminum-zinc alloys, magnesium-zinc alloys, aluminum-silicon alloys, aluminum-copper-zinc-magnesium alloys, cooper-tin bronzes, brass, aluminum bronzes, steels, cast irons, tool steels, stainless steels, super-alloys, and cobalt-chromium alloys, or pure metals such as iron, copper or aluminum.

Figure 2:
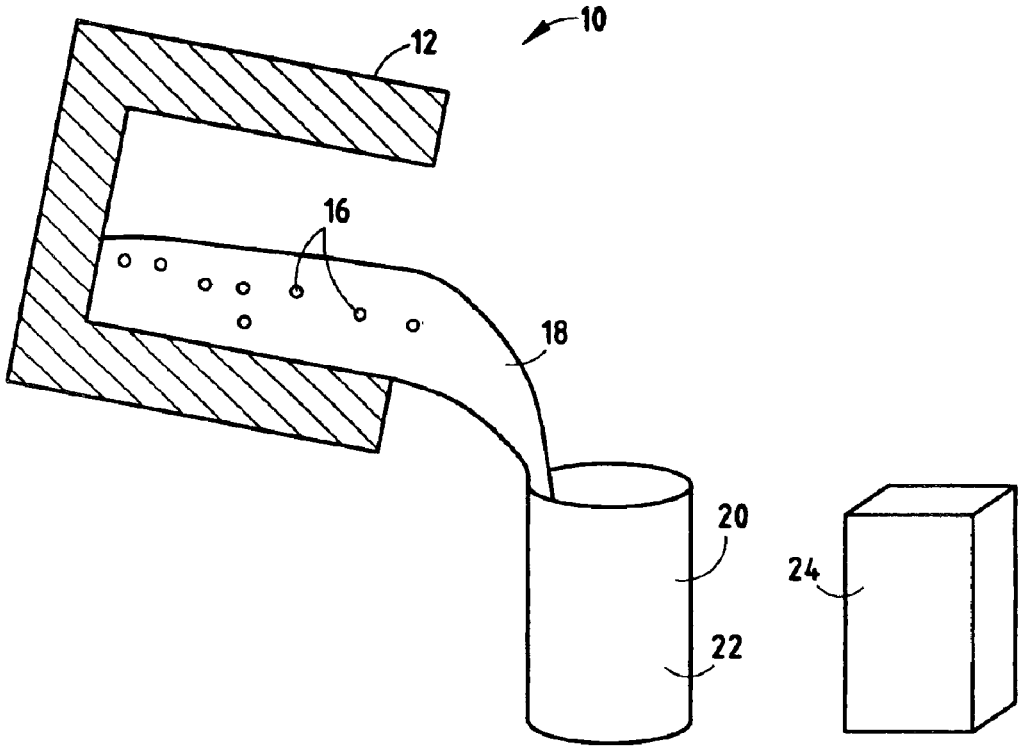
FIG. 2 is a schematic illustration of another embodiment in accordance with the invention.

In FIG. 2 there is shown an alternative embodiment of the invention which includes an apparatus 10 generally similar to that of the embodiment shown in FIG. 1, but including a cooling vessel 20 into which the slurry 18 is transferred after agitation in holding vessel 12 has been completed and the solids content has been raised to a value of from about 1% to about 20%. Cooling vessel 20 has walls 22 that are made of a material having a high thermal conductivity. Vessel walls 22 may be designed with a total heat capacity (specific heat capacity of the walls times the mass of the walls) that allows rapid temperature equilibration of the walls 22 with a given quantity of slurry 18 to achieve rapid cooling of the slurry to the desired solids content when the vessel walls 22 are maintained at a relatively cool predetermined temperature prior to contact with the slurry. A fan or blower 24 may be employed to effect high rates of heat transfer from the slurry though the walls 22 and from walls 22 to the surrounding air, whereby rapid cooling of slurry 18 is effected. This allows higher rates of production.

Suitable materials having high thermal conductivity may be employed in fabricating the walls of vessel 20 include steel, stainless steel and graphite. Graphite is particularly well suited for high production at a low cost because it has a fairly high thermal conductivity that is comparable to metals, and a surface that exhibits a low wettability for various metal alloys of interest (e.g., aluminum and magnesium alloys). As a result, relatively rapid cooling of the alloy slurry from a lower solids content (e.g., from about 1% to about 20%) to a relatively higher solids content (e.g., from about 10% to about 65%) is possible, while the surface of vessel 20 can be reused without subsequent cleaning to remove metal deposits and/or cleaning to remove metal deposits is easier, whereby higher production rates are possible at a lower cost. When vessel 20 is fabricated of a metal or other material possessing a wettable surface relative to the slurry, the inner surfaces of the vessel which come in contact with the alloy slurry are preferably coated with a low wettability coating such as a boron nitride coating.

Cooling vessel 20 may also be cooled by passing a heat transfer fluid through cooling channels formed or otherwise provided within the walls of the cooling vessel. Also, the cooling vessel may be configured with an appropriate surface area, mass and heat capacity to effect rapid cooling of the slurry from a relatively low solids content to a desired higher solids content under quiescent conditions without cooling the slurry to a temperature below that which is suitable for forming into a desired metal component.

After the slurry 18 has been cooled to a desired higher solids content without agitation (i.e., under quiescent conditions), the slurry is formed into desired metal components, such as by casting.

$1^{ST}$ Example of Graphite Agitator

A molten batch of aluminum alloy is held in a container. The aluminum alloy has the following properties:

Temperature ($T_l$)=640° C.

Latent Heat of Fusion ($H_f$)=400,000 J/kg (where J is a Joule, a unit of energy)

Heat Capacity of Aluminum ($C_P$)≈1,000 J/(kg ° C.)

Amount of aluminum alloy (m)≈4 kg

To cool the partially solidified aluminum alloy to a temperature of 610° C. and a fraction solid of 0.10, the following amount of heat must be removed:

Fraction Solid ($\Delta f_s$)=0.10

Temperature ($T_f$)=610° C.

$$\Delta H = m \cdot \Delta f_s H_f + m \int_{Ti}^{Tf} C_p \, dT$$

$$H = 4(\text{kg}) \cdot 0.10 \cdot 400{,}000\left(\frac{\text{J}}{\text{kg}}\right) + 4(\text{kg}) \cdot (30^\circ\,\text{C.}) \cdot 1{,}000\left(\frac{\text{J}}{\text{kg}^\circ\,\text{C.}}\right) = 280{,}000\ \text{J}$$

To remove 280,000 Joules of energy, the rod must have sufficient mass and heat capacity to absorb this amount of energy. The rod must also have a high enough thermal diffusivity, α, to allow for heat to transfer within the rod away from the surface, maintaining the surface temperature below the liquid temperature of the alloy.

Graphite Cylindrical Agitator:

Outer Radius ($R_o$)=0.025 m

Height of Cylinder (H)=0.25 m

Volume of Cylinder=$V=\pi R_o^2 H=4.91\times10^{-4}$ $m^3$

Density of Graphite≈1,800 kg/$m^3$

Mass of Graphite=0.88 kg

The rod can remove the following amount of heat if the rod's initial temperature is at 100° C. and rises to 500° C.

Temperature of Rod=100° C.

Mass of Graphite Container=0.88 kg

Heat Capacity of Graphite≈800 J/(kg ° C.)

$$\Delta H = m \int_{Ti}^{Tf} C_p \, dT = 0.88\ \text{kg} \cdot 400^\circ\,\text{C.} \cdot 800 \frac{\text{J}}{\text{kg}^\circ\,\text{C.}} \cong 280{,}000\ \text{J}$$

The rod has sufficient mass and heat capacity to absorb the amount of energy from the aluminum to cool the alloy from above its liquidus temperature to below it liquidus temperature.

Thermal Diffusivity

The rod extracts heat from the molten aluminum alloy through its surface according to the following heat transfer equation:

$$q(W)=hA\Delta T$$

Heat Transfer Coefficient (h)≈1,500 W/($m^2$° C.), where W is a Watt (J/s).

Surface Area of the Rod=0.0393 $m^2$

Average Temperature Difference=250° C.

$$q(\mathrm{W}) = hA\Delta T$$
$$= 1,500\left(\frac{\mathrm{W}}{m^2\,{}^\circ\mathrm{C.}}\right)\cdot 0.0393(m^2)\cdot 250({}^\circ\mathrm{C.})$$
$$\approx 15{,}000\ \mathrm{W}$$

The rod must remove 280,000 J, and the rate of heat transfer is 15,000 W, therefore, the required time of heat removal is approximately 19 seconds. This duration will vary depending on the thermophysical properties of the alloy, the initial temperature of the alloy, and the mass and thermophysical properties of the rod.

Thermal diffusivity (α) is defined as the thermal conductivity (k) divided by the density (ρ) of the material multiplied by the heat capacity ($C_P$):

$$\alpha = \frac{k}{\rho C_p}$$

For a material with a relatively low thermal conductivity and high density, such as a ceramic material, the thermal diffusivity is low. The material is unable to transfer heat away from its surface to its interior, therefore, the surface temperature equilibrates with the alloy, and it is unable to further reduce the temperature of the alloy.

In addition to having a large enough mass to absorb the energy from the alloy, the rod material must also have a suitable thermal diffusivity to remove heat from the rod's surface to its interior.

A rod with a high thermal diffusivity could have a smaller mass than what is normally required to absorb enough energy to initiate solidification in the alloy if a heat transfer fluid is used to remove heat from the rod concomitantly with stirring and heat extraction.

$2^{ND}$ Example of Graphite Agitator

Consecutive molten batches of aluminum alloy are held in a container. The aluminum alloy has the following procedures:

Temperature of $1^{st}$ batch ($T_l$)=640° C.

Temperature of $2^{nd}$ batch ($T_l$)=657° C.

Latent Heat of Fusion ($H_f$)=400,000 J/kg (where J is a Joule, a unit of energy)

Heat Capacity of Aluminum ($C_P$)≈1,000 J/(kg ° C.)

Amount of aluminum alloy (m)≈4 kg

To cool the partially solidified aluminum alloy to a temperature of 610° C. and a fraction solid of 0.10, the following amount of heat must be removed:

Fraction Solid ($\Delta f_s$)=0.10

Temperature ($T_f$)=610° C.

$$\Delta H = m\cdot\Delta f_s\cdot H_f + m\int_{Ti}^{Tf} C_p\,dT$$

Batch 1:

$$\Delta H = 4(\mathrm{kg})\cdot 0.10\cdot 400{,}000\left(\frac{\mathrm{J}}{\mathrm{kg}}\right) + 4(\mathrm{kg})\cdot(30^\circ\ \mathrm{C.})\cdot 1{,}000\left(\frac{\mathrm{J}}{\mathrm{kg}\ {}^\circ\mathrm{C.}}\right)$$
$$= 280{,}000\ \mathrm{J}$$

Batch 2:

$$\Delta H = 4(\mathrm{kg})\cdot 0.10\cdot 400{,}000\left(\frac{\mathrm{J}}{\mathrm{kg}}\right) + 4(\mathrm{kg})\cdot(47^\circ\ \mathrm{C.})\cdot 1{,}000\left(\frac{\mathrm{J}}{\mathrm{kg}\ {}^\circ\mathrm{C.}}\right)$$
$$= 348{,}000\ \mathrm{J}$$

The rod in this example can remove 15000 W. In Batch 1, the rod must remove 280,000 J while in Batch 2 the road must remove 348,000 J. The required time to remove the heat from Batch 1 and Batch 2 is 19 and 23 s, respectively.

By measuring the temperature of the molten bath prior to cooling and stirring with the agitator, variations in temperature can be eliminated within the semi-solid slurry. Stirring duration can be determined by an algorithm that is based on incoming metal temperature, rod temperature, time delays (loss of energy to surroundings), etc.

Example of Cylindrical Container (Cooling Cup)

A partially solidified batch of aluminum alloy is held in a container. The aluminum alloy has the following properties:

Temperature ($T_l$)=610° C.

Fraction Solid ($f_s$)≈0.10

Latent Heat of Fusion ($H_f$)=400,000 J/kg (where J is a Joule, a unit of energy)

Heat Capacity of Aluminum ($C_P$)≈1,000 J/(kg ° C.)

Amount of aluminum alloy (m)≈4 kg

To cool the partially solidified aluminum alloy to a temperature of 590° C. and a fraction solid of 0.30, the following amount of heat must be removed:

Fraction Solid Difference ($\Delta f_s$)=0.20

Temperature ($T_f$)=590° C.

$$\Delta H = m\cdot\Delta f_s H_f + m\int_{Ti}^{Tf} C_p\,dT$$

$$H = 4(\mathrm{kg})\cdot 0.10\cdot 400{,}000\left(\frac{\mathrm{J}}{\mathrm{kg}}\right) + 4(\mathrm{kg})\cdot(20^\circ\ \mathrm{C.})\cdot 1{,}000\left(\frac{\mathrm{J}}{\mathrm{kg}\ {}^\circ\mathrm{C.}}\right)$$
$$= 400{,}000\ \mathrm{J}$$

To remove 400,000 Joules of energy, a container is designed to absorb this amount of heat. A thin-walled graphite container with the following properties can remove this heat.

Graphite Cylindrical Container:

Inner Radius ($R_i$)=0.0508 m

Outer Radius ($R_o$)=0.0568 m

Height of Cylinder (H)=0.2346 m

Wall Thickness (t)=0.006 m

Volume of Cylinder=$V=\pi R_o^2 t+2\pi R_o\cdot(H-t)\cdot t=5.38\times10^{-4}$ $m^3$ Density of Graphite≈1,800 kg/$m^3$ Mass of Graphite=0.97 kg The graphite can remove the following amount of heat if its initial temperature is at 90° C. and it equilibrates with the aluminum at 590° C.

Temperature of Graphite=90° C.

Mass of Graphite Container=0.97 kg

Heat Capacity of Graphite≈800 J/(kg° C.)

$$\Delta H = m\int_{Ti}^{Tf} C_p\, dT = 0.97\ \text{kg}\cdot 500^\circ\text{C.}\cdot 800\frac{\text{J}}{\text{kg}^\circ\text{C.}} \cong 400{,}000\ \text{J}$$

The graphite container requires the same amount of heat to reach a temperature of 590° C. Thus, the graphite container is designed to rapidly remove a predetermined amount of heat to rapidly increase the solids content from a first value in the range of from about 1% to about 10% by weight, to a second value in the range of 10% to 65% by weight.

The above description is considered that of the preferred embodiments only. Modifications of the invention will occur to those skilled in the art and to those who make or use the invention. Therefore, it is understood that the embodiments described above are merely for illustrative purposes and not intended to limit the scope of the invention, which is defined by the following claims as interpreted according to the principles of patent law, including the doctrine of equivalents.

What is claimed is:

1. A method of producing a metal component from a liquid metal alloy composition, comprising:

forming a liquid metal alloy composition that is free of solid material;

positioning a quantity of the liquid metal alloy composition in a holding vessel;

inserting a graphite agitator into the liquid metal alloy composition in the holding vessel;

agitating the liquid metal alloy composition with the graphite agitator while cooling the metal alloy composition to initiate solidification and form a non-dendritic semi-solid slurry;

ceasing agitation and removing the graphite agitator from the non-dendritic semi-solid slurry after the solids content of the slurry has risen to a value of from about 1% to about 20% by weight;

cooling the non-dendricic semi-solid slurry without agitation until the solids content has risen to a value of from about 10% to about 65%; and transferring the non-dendritic semi-solid slurry having a solids content of from about 10% to about 65% to a component forming apparatus and shaping the transferred material into a desired metal component.

2. The method of claim 1, wherein cooling of the non-dendritic semi-solid slurry is achieved by transferring the non-dendritic semi-solid slurry having a solids content of from about 1% to about 20% by weight to a cooling vessel, and cooling the slurry in the cooling vessel.

3. The method of claim 2, wherein the cooling vessel has walls made of graphite.

4. The method of claim 2, wherein air is blown along the walls of the cooling vessel.

5. The method of claim 2, wherein the cooling vessel has walls made of a material selected from steel and stainless steel.

6. The method of claim 5, wherein the internal walls of the cooling vessel are provided with a non-wetting or reduced wetting coating.

7. The method of claim 6, wherein the coating is a boron nitride coating.

8. The method of claims 1, wherein the liquid metal alloy composition is agitated for a predetermined duration based on the initial temperature of the metal alloy composition and the heat extraction rate of the agitator.

9. An apparatus for direct production of a non-dendritic, semi-solid metal alloy slurry from a liquid state for subsequent forming into a metal component, comprising:

a vessel for containing a metal alloy composition; and a graphite agitator for inducing convection while rapidly cooling said metal composition to initiate solidification and forming non-dendritic solid particles in the metal alloy composition.

10. The apparatus of claim 9, further comprising a separate cooling vessel.

11. The apparatus of claim 10, wherein the cooling vessel has walls made of graphite.

12. The apparatus of claim 10, wherein the cooling vessel has walls made of a material selected from steel and stainless steel.

13. The apparatus of claim 12, wherein the internal walls of the cooling vessel are provided with a non-wetting or reduced wetting coating.

14. The apparatus of claim 13, wherein the coating is a boron nitride coating.

15. A method of producing a metal component from a liquid metal alloy composition, comprising:

forming a liquid metal alloy composition that is free of solid material;

transferring a quantity of the liquid metal alloy composition to a holding vessel;

inserting an agitator into the liquid metal alloy composition in the holding vessel;

agitating the liquid metal alloy composition in the holding vessel with the agitator while cooling the liquid metal alloy composition in the holding vessel to initiate solidification and form a non-dendritic semi-solid slurry;

ceasing agitation and removing the agitator from the non-dendritic semi-solid slurry after the solids content has risen to a value of from about 1% to about 20% by weight;

transferring the slurry having a solids content of from about 1% to about 20% by weight to a cooling vessel and cooling the slurry without agitation until the solids content has risen to a value of from about 10% to about 65% by weight; and transferring the non-dendritic semi-solid slurry having a solids content of from about 10% to about 65% to a component forming apparatus and shaping the transferred material into a desired metal component.

16. The method of claim 15, wherein the cooling vessel has walls made of graphite.

17. The method of claim 15, wherein air is blown along the walls of the cooling vessel.

18. The method of claim 15, wherein the cooling vessel has walls made of a material selected from steel and stainless steel.

19. The method of claim 18, wherein the internal walls of the cooling vessel are provided with a non-wetting or reduced wetting coating.

20. The method of claim 19, wherein the coating is a boron nitride coating.

21. The method of claims 15, wherein the liquid metal alloy composition is agitated for a predetermined duration based on the initial temperature of the metal alloy composition and the heat extraction rate of the agitator.

22. An apparatus for production of a non-dendritic semi-solid metal alloy slurry from a liquid state for subsequent forming into a metal component, comprising:

a vessel for containing a metal alloy composition;

an agitator for inducing convection while rapidly cooling said metal composition to initiate solidification and forming non-dendritic solid particles in the metal alloy composition; and a cooling vessel for further cooling and raising the solids content of the slurry.

23. The apparatus of claim 22, wherein the cooling vessel has walls made of graphite.

24. The apparatus of claim 22, wherein the cooling vessel has walls made of a material selected from steel and stainless steel.

25. The apparatus of claim 24, wherein the internal walls of the cooling vessel are provided with a non-wetting or reduced wetting coating.

26. The apparatus of claim 25, wherein the coating is a boron nitride coating.

27. A method of producing a metal component from a liquid metal alloy composition, comprising:

forming a liquid metal alloy composition that is free of solid material;

positioning a quantity of the liquid metal alloy composition in a holding vessel;

inserting an agitator into the liquid metal alloy composition in the holding vessel;

agitating the liquid metal alloy composition with the agitator while cooling the metal alloy composition to initiate solidification and form a non-dendritic semi-solid slurry;

ceasing agitation and removing the agitator from the non-dendritic semi-solid slurry after the solids content of the slurry has risen to a value of from about 1% to about 20% by weight;

cooling the non-denciritic semi-solid slurry without agitation until the solids content has risen to a value of from about 10% to about 65%; and transferring the non-dendritic semi-solid slurry having a solids content of from about 10% to about 65% to a component forming apparatus and shaping the transferred material into a desired metal component.

* * * * *

UNITED STATES PATENT AND TRADEMARK OFFICE

CERTIFICATE OF CORRECTION

PATENT NO. : 6,918,427 B2
DATED : July 19, 2005
INVENTOR(S) : James A. Yurko

It is certified that error appears in the above-identified patent and that said Letters Patent is hereby corrected as shown below:

Column 1,
Lines 10 and 15, after "A" insert -- . --.

Column 6,
Line 13, after "formation" insert -- of --.
Line 49, "form" should be -- from --.

Column 7,
Line 23, "cooper-tin" should be -- copper-tin --.
Line 44, "include" should be -- including --.

Column 8,

Line 32, " $\Delta H = m \cdot \Delta f_s \cdot H_f + m \int_{Ti}^{Tf} C_P dT$ " should be -- $\Delta H = m \cdot \Delta f_s \cdot H_f + m \int_{Ti}^{Tf} C_P dT$ --.

Line 66, "it" should be -- its --.

Column 10,
Line 26, "road" should be -- rod --.

Line 55, " $\Delta H = m \cdot \Delta f_s \quad H_f + m \int_{Ti}^{Tf} C_P dT$ " should be -- $\Delta H = m \cdot \Delta f_s \cdot H_f + m \int_{Ti}^{Tf} C_P dT$ --.

Line 58, " $\mathrm{H} = 4(\mathrm{kg}) \cdot 0.10 \cdot 400{,}000 (\frac{J}{kg}) +$ $4(\mathrm{kg}) \cdot (20°\mathrm{C.}) \cdot 1{,}000 (\frac{J}{kg \circ C.}) = 400{,}000\ \mathrm{J}$ " should be -- $\Delta H = 4(kg) \cdot 0.20 \cdot 400{,}000 (\frac{J}{kg}) + 4(kg) \cdot (20°C) \cdot 1{,}000 (\frac{J}{kg°C}) = 400{,}000\, J$ --.

UNITED STATES PATENT AND TRADEMARK OFFICE

CERTIFICATE OF CORRECTION

PATENT NO. : 6,918,427 B2
DATED : July 19, 2005
INVENTOR(S) : James A. Yurko

It is certified that error appears in the above-identified patent and that said Letters Patent is hereby corrected as shown below:

Column 13,
Line 9, “claims” should be -- claim --.

Signed and Sealed this

Seventh Day of February, 2006

JON W. DUDAS
*Director of the United States Patent and Trademark Office*